US008756957B2

(12) United States Patent
Kim et al.

(10) Patent No.: US 8,756,957 B2
(45) Date of Patent: Jun. 24, 2014

(54) TUB FOR A WASHING MACHINE WITH A BEARING HOUSING INSERTED THEREIN

(75) Inventors: Hyeok Deok Kim, Changwon-si (KR); Byung Hwan Ahn, Gimhae-si (KR); Hung Myong Cho, Gimhae-si (KR)

(73) Assignee: LG Electronics Inc., Seoul (KR)

( * ) Notice: Subject to any disclaimer, the term of this patent is extended or adjusted under 35 U.S.C. 154(b) by 374 days.

(21) Appl. No.: 12/300,490

(22) PCT Filed: May 12, 2006

(86) PCT No.: PCT/KR2006/001793

§ 371 (c)(1),
(2), (4) Date: Nov. 12, 2008

(87) PCT Pub. No.: WO2007/132955

PCT Pub. Date: Nov. 22, 2007

(65) Prior Publication Data

US 2009/0100879 A1 Apr. 23, 2009

(51) Int. Cl.

| | |
|---|---|
| ***D06F 37/30*** | (2006.01) |
| ***D06F 37/26*** | (2006.01) |
| *D06F 37/02* | (2006.01) |

(52) U.S. Cl.
USPC ..... 68/140

(58) Field of Classification Search
USPC ..... 68/140, 133, 139, 142
See application file for complete search history.

(56) References Cited

U.S. PATENT DOCUMENTS

| | | | | | |
|---|---|---|---|---|---|
| 2,620,070 | A | * | 12/1952 | Dodge | 210/365 |
| 4,792,475 | A | * | 12/1988 | Bien | 428/137 |
| 5,433,091 | A | * | 7/1995 | Durazzani et al. | 68/140 |
| 5,965,236 | A | * | 10/1999 | Durazzani | 428/156 |
| 6,681,602 | B2 | * | 1/2004 | Heyder et al. | 68/140 |
| 6,783,675 | B1 | * | 8/2004 | Sans Rovira et al. | 210/360.1 |
| 2004/0163428 | A1 | * | 8/2004 | Kim et al. | 68/140 |

FOREIGN PATENT DOCUMENTS

| | | | |
|---|---|---|---|
| DE | 2 225 780 | * | 6/1982 |
| DE | 36 15 555 | * | 1/1987 |
| DE | 60318676 | | 1/2009 |
| EP | 1 428 924 B1 | | 1/2008 |
| GB | 2 272 913 | * | 6/1974 |
| GB | 2 189 511 | * | 10/1987 |
| GB | 2 333 300 | * | 7/1999 |

(Continued)

OTHER PUBLICATIONS

International PCT Search Report dated Mar. 13, 2007.

(Continued)

*Primary Examiner* — Joseph L Perrin
(74) *Attorney, Agent, or Firm* — Ked & Associates, LLP

(57) ABSTRACT

A tub (100) for a washing machine, and a washing machine comprising the same are disclosed. The tub (100) is formed through injection molding with a bearing housing (200) inserted therein, and the washing machine comprises the same. Here, the bearing housing (200) comprises a flange (210) extending to have a protruded part (216) and a recessed part (215) in a radial direction. The tub (100), and the washing machine comprising the same solve the problems of the conventional washing machine, and fulfill various requirements. The tub (100) has excellent strength and rigidity of the rear wall thereof, exhibits a strong coupling force with respect to the inserted bearing housing (200), and reduces manufacturing costs. Thus, the washing machine has all the characteristics of the tub (100).

20 Claims, 9 Drawing Sheets

(56) References Cited

FOREIGN PATENT DOCUMENTS

| | | | |
|---|---|---|---|
| JP | 54-054463 | * | 4/1979 |
| JP | 63-281695 | * | 11/1988 |
| JP | 05-300997 | * | 11/1993 |
| JP | 06-341256 | * | 12/1994 |
| JP | 11-276774 | * | 10/1999 |
| KR | 10-0214260 B1 | | 5/1999 |
| KR | 2001-68340 | * | 7/2001 |
| KR | 10-2005-0053211 A | | 6/2005 |
| WO | WO 2004/042133 | * | 5/2004 |
| WO | WO 2005/033400 | * | 4/2005 |

OTHER PUBLICATIONS

Korean Office Action dated Dec. 24, 2010.
German Office Action dated Nov. 14, 2012. (with translation).

* cited by examiner

TUB FOR A WASHING MACHINE WITH A BEARING HOUSING INSERTED THEREIN

TECHNICAL FIELD

The present invention relates to a tub for a washing machine and a washing machine comprising the same. More particularly, the present invention relates to a tub made by insert molding and a washing machine comprising the same. The tub is formed through injection molding with a bearing housing inserted therein. Here, the bearing housing comprises a flange formed to have a protruded part and a recessed part in a radial direction.

BACKGROUND ART

Generally, washing machines perform washing operation, rinsing operating, spin-drying operation, and the like through rotation of a rotational tub and a pulsator via driving force of a motor. Upon washing operation, water and laundry in the rotational tub are agitated such that the laundry is washed via friction between the laundry and the tub as well as the water. The washing machines can be classified into pulsator type washing machines, agitator type washing machines, drum type washing machines, and the like according to manners of washing operation.

In particular, the drum type washing machines can be classified into an indirect-coupled type in which driving force of a motor is indirectly transferred to a drum via a belt wound around a motor pulley and a drum pulley, and a direct-coupled type in which the driving force is directly transferred to the drum via a rotor of a BLDC motor which is directly coupled to the drum.

For the indirect-coupled type, as the driving force of the motor is not directly transferred to the drum, but indirectly transferred thereto through the belt wound around the motor pulley and the drum pulley, there are problems in that energy waste and noise generated during transfer of the driving force are excessive.

Currently, there is an increasing tendency of using the direct-coupled type drum washing machine which employs the BLDC motor in order to solve the problems of the conventional drum washing machines.

The construction of the direct-coupled type drum washing machine will be described briefly as one example of conventional washing machines with reference to FIG. 1 as follows.

FIG. 1 is a longitudinal sectional view of the convention drum washing machine which comprises a tub 2 installed within a cabinet 1, and a drum rotatably installed coaxially in the tub 2.

The tub 2 is provided at a rear side with a motor which comprises a stator 6 and a rotor 5. The stator 6 is fixed to a rear wall of the tub 2, and the rotor 5 surrounding the stator 6 penetrates the tub 2 and is then coupled to the drum 3 via the shaft.

FIG. 2 is a partially cut perspective view illustrating a part of the rear wall of the tub.

The rear wall of the tub 2 is provided at its center with a metallic bearing housing 7, which can support bearings positioned on an outer periphery of both ends of a shaft 4, and receives the stator 6 fastened thereto.

The rear wall of the tub 2 is formed with stepped sections 21 and non-stepped sections 22. Each of the stepped sections 21 has a stepped coupling portion 23 formed adjacent to the center of the tub 2 where the bearing housing is positioned, such that the stator 6 is coupled to the coupling portion 23. Each of the non-stepped sections 22 is provided with a reinforcing rib 22*a*.

FIG. 3 is a perspective view illustrating the configuration of the stator 6. The stator 6 comprises a ring-shaped core 61 around which a oil 66 is wound, insulators 62 and 63, a hole sensor assembly 64, and a tab housing assembly 65 for connection with a power source.

Here, the insulators 62 and 63 comprise a first insulator 62 and a second insulator 63 formed to encase upper and lower surfaces of the core 6 as shown in the drawing. The insulators 62 and 63 have a plurality of bulges 62*a* and 63*a* formed on an inner side thereof so as to define fastening holes 62*b* and 63*b* therein, respectively.

The fastening holes 62*b* and 63*b* are fastened to the coupling portions 23 on the rear wall of the tub 2 by means of bolts.

Here, the upper surface of the first insulator 62 is formed with a plurality of positioning protrusions 62*c* adjacent to the bulges 62*a* to allow the stator 6 to be positioned on the rear wall of the tub when the stator 6 is coupled to the rear wall of the tub. Correspondingly, on the rear wall of the tub 2, the coupling portions 23 are formed with a plurality of positioning holes 23*a* in which the positioning protrusions 62*c* will be inserted, respectively.

For the washing machine in which the drum 2 is directly rotated by means of the BLDC motor, the stator 6 is directly mounted to a securing side on the rear wall of the tub 2 as shown in FIG. 4. When considering the weight of the stator 6, vibration thereof upon rotation of high speeds, and shaking and deformation of the rotor 5, a fastening portion between the stator 6 and the tub 2 is required to have a strong structure. In particular, for a large capacity drum washing machine which comprises a stator 6 having a weight of 1.5 kg or more, and has a rotational speed of 600~2,000 rpm upon spin-drying operation, it is necessary to have a higher structural strength.

Meanwhile, even for other types of washing machine as well as the direct-coupled type washing machine, the rear wall of the tub is required to have high strength and rigidity in the case where the bearing housing is inserted in the rear wall of the tub. The reason is that vibration of a rotational shaft serving to rotate the drum is transferred to the rear wall of the tub via the bearing housing, thus requiring the rear wall of the tub to have a sufficient structural strength.

Thus, if the tub is formed by injection molding with the bearing housing inserted therein, it is desirable that the bearing housing have a flange. The flange is designed to enhance the strength and rigidity of the rear wall of the tub. In addition, the flange serves to enhance coupling force between the bearing housing and the tub.

Accordingly, for the tub formed by the injection molding with the bearing housing having the flange inserted therein, the structure of the flange is very important. When the flange is designed, the strength and rigidity of the rear wall of the tub and the coupling force between the bearing housing and the tub need to be taken into consideration. In addition, since the flange is inserted in the rear wall of the tub, the shape of the flange influences an inner volume of the tub, and as a result, influences the capacity of the washing machine. As such, when constructing the flange, various factors as mentioned above mist be considered.

Further, the structure of the flange also influences manufacture of a mold for the tub as well as manufacture of a mold for the bearing housing. Thus, the flange must be designed to allow easy manufacturing of the mold therefor while redoing costs for manufacturing the mold. That is, the flange must have a simple structure in order to reduce the costs for the mold while allowing easy manufacturing thereof.

DISCLOSURE OF INVENTION

Technical Problem

An object of the present invention devised to solve the problem lies on a tub for a washing machine, which fulfills requirements as described above, and on a washing machine comprising the same.

It is another object of the present invention to provide the tub, which is formed by injection molding with a bearing housing inserted therein, has excellent strength and rigidity of a rear wall thereof, exhibits a strong coupling force with respect to the inserted bearing housing, and can reduce manufacturing costs, and to provide the washing machine comprising the same.

Technical Solution

The object of the present invention can be achieved by providing a washing machine comprising a tub formed by injection molding with a bearing housing inserted in the tub.

The bearing housing may comprise a bearing support to receive bearings; and a flange extending from the bearing support to have a protruded part and a recessed part which are arranged radially.

The flange has radial ribs formed in a radial direction. The radial ribs serve to reinforce strength of the flange, and in turn, increase strength of the rear wall of the tub.

In addition, the radial ribs also serve to increase coupling force between the bearing housing and the rear wall of the tub. For example, when manufacturing a plastic tub, melted plastic is injected into a cavity of a mold having the bearing housing inserted therein, and is then cooled, thereby producing the tub. In this regard, since the bearing housing is formed of a metallic material such as aluminum, adhesion between the bearing housing and the plastic is weak, and results in low coupling force between the bearing housing and the rear wall of the tub. In this regard, the radial ribs increase the coupling force therebetween.

The radial ribs are preferably formed on both sides of the flange.

Preferably, the flange further comprises a plurality of through-holes. With this structure, the melted plastic flows through the through-holes, and connects an inner side of the rear wall of the tub with an outer side thereof, thereby further increasing the coupling force between the flange and the bearing housing.

Each of the through-holes may have a slot shape or a circular shape. In addition, the through-holes are arranged along each circumference of the flange. Uniform arrangement of the through-holes leads uniform transfer of load, thereby preventing concentration of load on a specific part.

The flange may further comprise a circumferential rib formed in a circumferential direction. The circumferential rib is preferably formed between the radial ribs to connect the radial ribs with each other. Preferably, the circumferential rib is also formed on both sides of the flange.

In some cases, the circumferential rib and the radial ribs may not be formed on a surface which faces an inner side of the rear wall of the tub so that the inner side of the rear wall of the tub is not formed with protrusions, thereby allowing the tub to have an increased inner volume.

When the circumferential rib is formed along with the radial ribs, they are preferably formed to cross each other. When the circumferential rib is formed to cross the radial ribs, there is a merit in that the structure is simplified. Additionally, this structure can prevent concentration of stress. If the circumferential rib is not formed to cross the radial ribs, the flange has an irregular shape, causing the concentration of stress.

In addition, the circumferential rib or the radial ribs are preferably formed in the recessed part of the flange.

Meanwhile, the flange may comprise bosses to fasten a stator of a motor for a direct-coupled type washing machine. For other types of washing machine, the bosses are not needed.

The bosses are preferably formed on the radial ribs or the circumferential ribs. In either case, the ribs serve to reinforce the bosses.

More preferably, the bosses are formed at crossing portions between the circumferential rib and the radial ribs in order to further increase structural strength of the bosses.

The flange may be continuously formed in the circumferential direction or be discontinuously formed in the circumferential direction. When the flange is continuously formed in the circumferential direction, the strength of the flange is increased correspondingly. On the other hand, when the flange is discontinuously formed in the circumferential direction, the inner and outer sides of the rear wall of the tub are connected via discontinuous parts of the flange, thereby further increasing the coupling force between the bearing housing and the rear wall of the tub.

The present invention as described above is applicable to a top-loading type washing machine to which laundry is loaded from above as well as a front-loading type washing machine as shown in FIGS. 1 to 4. In other words, the present invention is not limited to a specific type of washing machine.

Advantageous Effects

With this construction, the present invention can solve the problems of the conventional washing machine as described above, and provide the tub and the washing machine comprising the same, both of which fulfill the requirement as described above.

In addition, the present invention provides the tub which is made by insert molding, namely by injection molding with a bearing housing inserted therein, wherein the tub has excellent strength and rigidity of a rear wall of the tub, exhibits a strong coupling force with respect to the inserted bearing housing, and can resume manufacturing costs. Thus, the washing machine comprising the same has all characteristics of the tub according to the present invention.

BRIEF DESCRIPTION OF THE DRAWINGS

The accompanying drawings, which are included to provide a further understanding of the invention, illustrate embodiments of the invention and together with the description serve to explain the principle of the invention.

In the drawings.

BEST MODE FOR CARRYING OUT THE INVENTION

In following description, embodiments of the present invention will be described in relation to a front loading type drum washing machine which is a direct-coupled type, as an example.

The front loading type drum washing machine according to the present invention is similar to the conventional drum washing machine shown in FIGS. 1 to 4. Exceptionally, the drum washing machine according to the present invention has a rear wall structure of a tub as shown in FIG. 5 instead of the structure shown in FIG. 2. Thus, the rear wall structure of the tub shown in FIG. 5 will be mainly described as a distinguishable structure from the conventional direct-coupled type washing machine. In addition, a bearing housing shown in FIGS. 6 and 7 will be described as one embodiment of the bearing housing which is inserted in the tub. Further, a bearing housing shown in FIGS. 8 and 9 will be described as another embodiment of the bearing housing.

At first, as shown in FIG. 5, the tub 100 has the bearing housing 200 inserted in the rear wall thereof. The tub 100 is produced by plastic injection molding in such a way that the injection molding is performed after the bearing housing 200 is inserted in a mold for the tub. Specifically, after the bearing housing 200 is inserted in the mold for the tub 200, melted plastic is injected into a cavity of the mold, and is then cooled, thereby producing the tub 100 having the bearing housing 200 integrally inserted therein.

Figure 6:
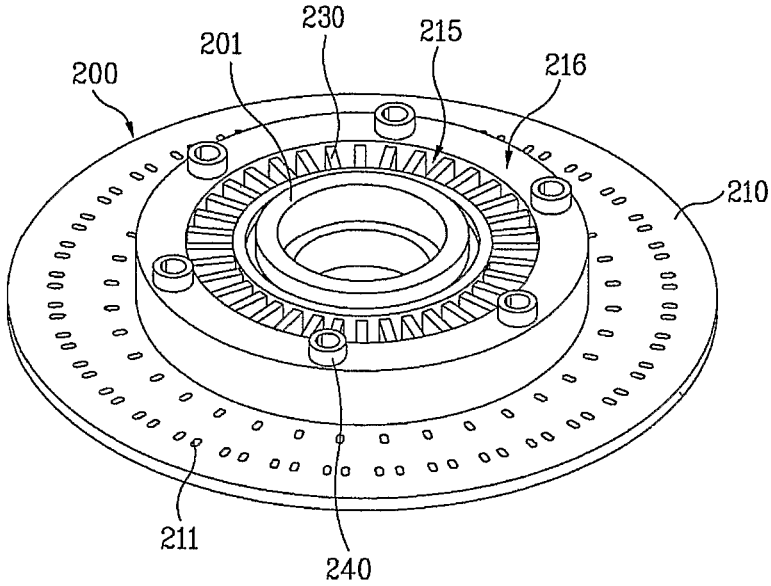
FIG. 6 illustrates one embodiment of a bearing housing inserted in the tub shown in FIG. 5.
Figure 7:
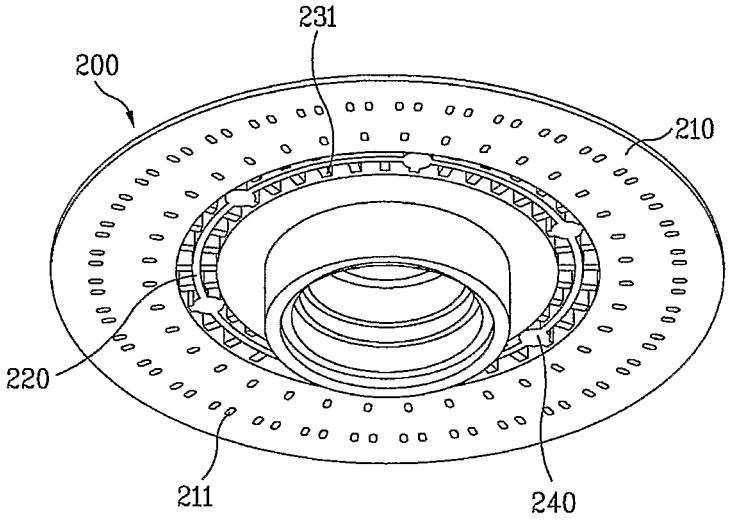
FIG. 7 illustrates a face of the bearing housing shown in FIG. 6 corresponding to an inner side of the rear wall of the tub.

The bearing housing 200 is shown in FIGS. 6 and 7, in which FIG. 6 shows one side of the bearing housing 200 corresponding to an cater side of the rear wall of the tub 100 and allowing a motor 5 or 6 (see FIG. 1 or FIG. 6) to be fastened thereto, and FIG. 7 shows the other side of the bearing housing 200 corresponding to an inner side of the rear wall of the tub 100.

As shown in the drawings, the bearing housing 200 comprises a bearing support 201 in which bearings (not shown) are positioned, and a flange 210 extending from the bearing support 201.

The flange 210 extends from the bearing support 201 to have a recessed part 215 and a protruded part 216. The recessed part 215 and the protruded part 216 are arranged in the radial direction. In addition, the flange 210 comprises radial ribs 230 formed in a radial direction. As shown in FIGS. 6 and 7, the radial ribs 230 are formed on both sides of the flange 210 in the recessed part 215. The radial ribs 230 and 231 serve to reinforce strength of the recessed part 215.

Figure 1:
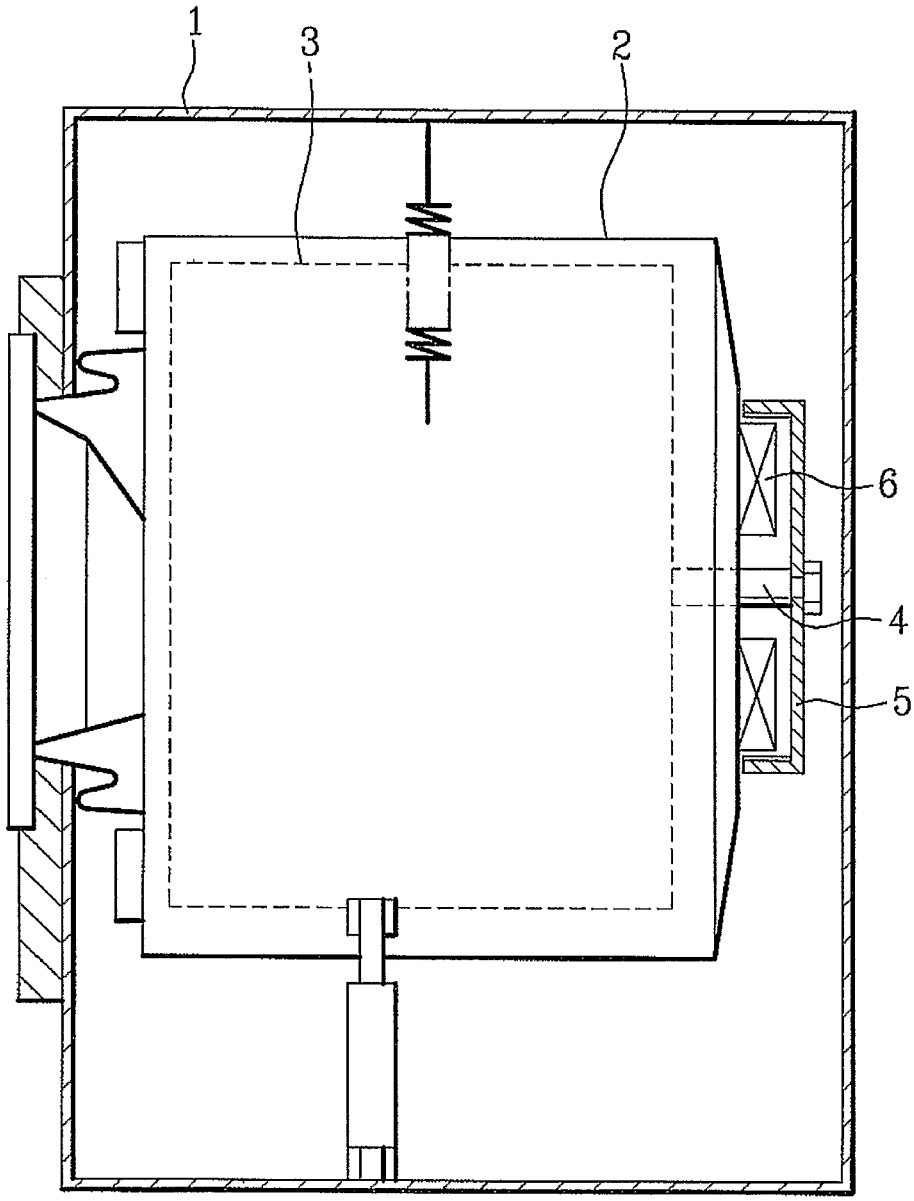
FIG. 1 is a longitudinal sectional view illustrating a convention direct-coupled type drum washing machine.
Figure 2:
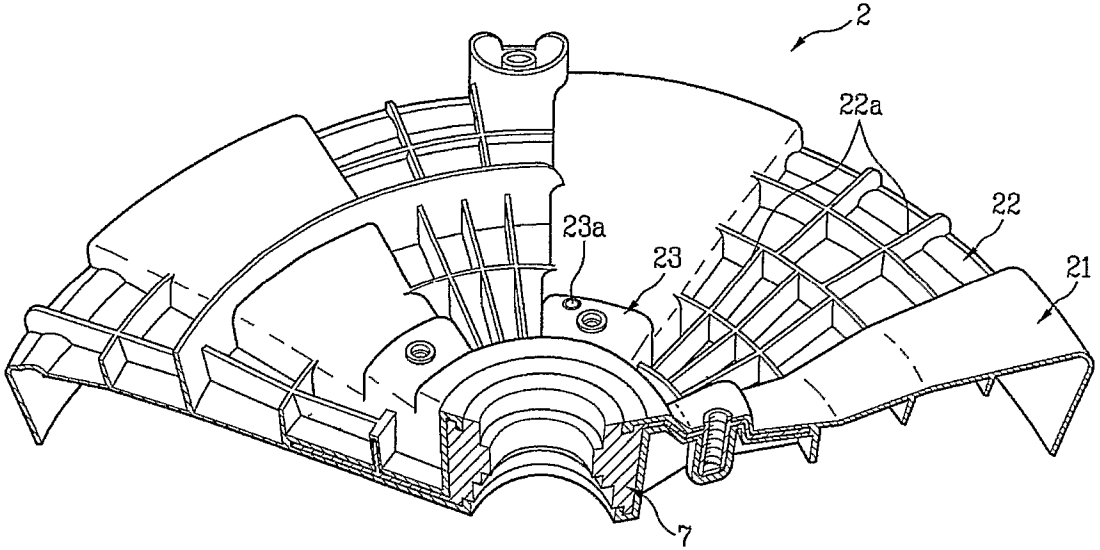
FIG. 2 is a partially cut perspective view illustrating a part of a rear wall of a tub of the direct-coupled type drum washing machine.
Figure 3:
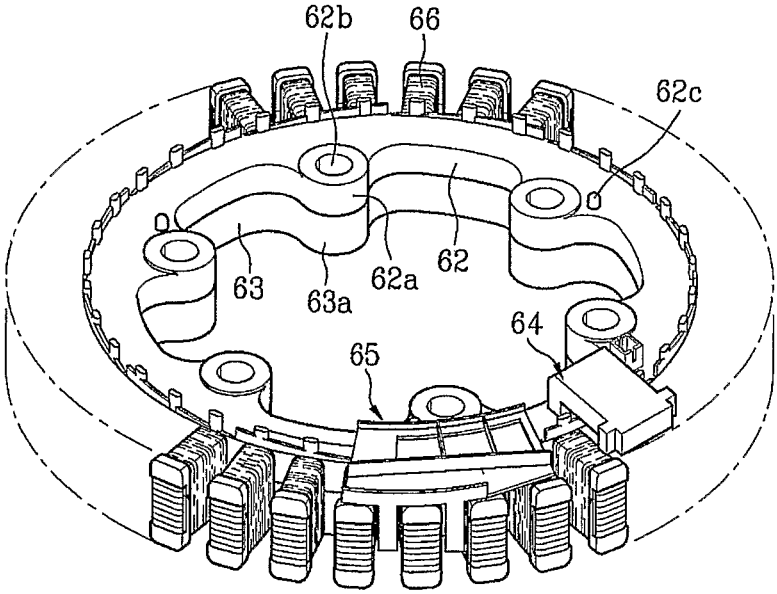
FIG. 3 is a perspective view illustrating the configuration of a stator of the direct-coupled type drum washing machine.
Figure 4:
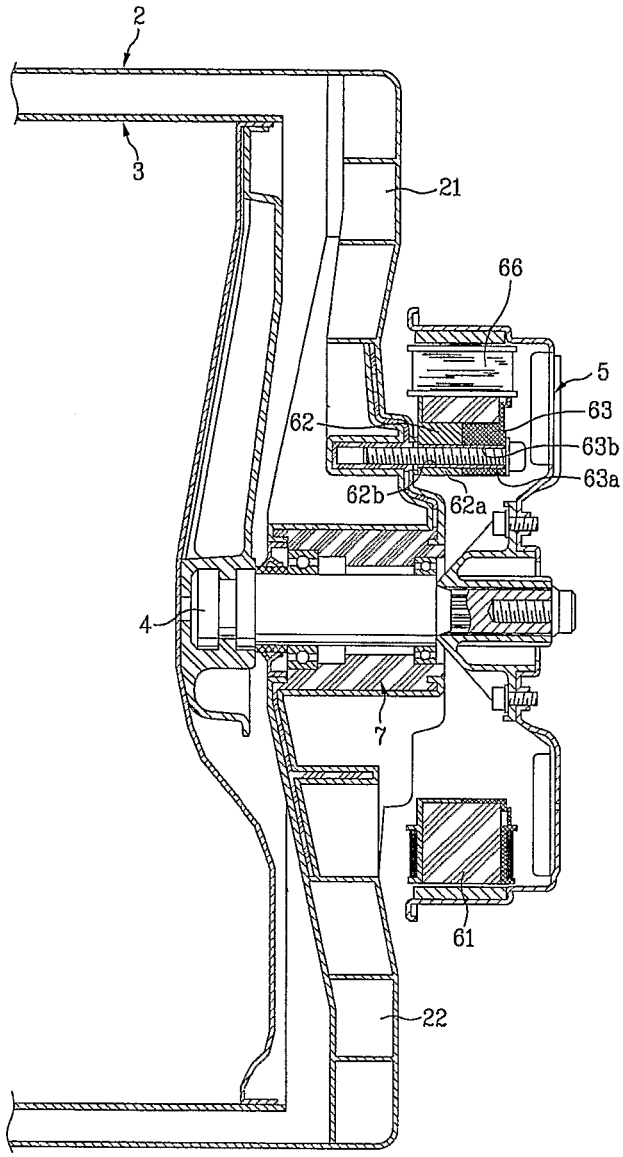
FIG. 4 is a longitudinal sectional view illustrating a coupled structure between the tub and the stator of the direct-coupled type drum washing machine.
Figure 5:
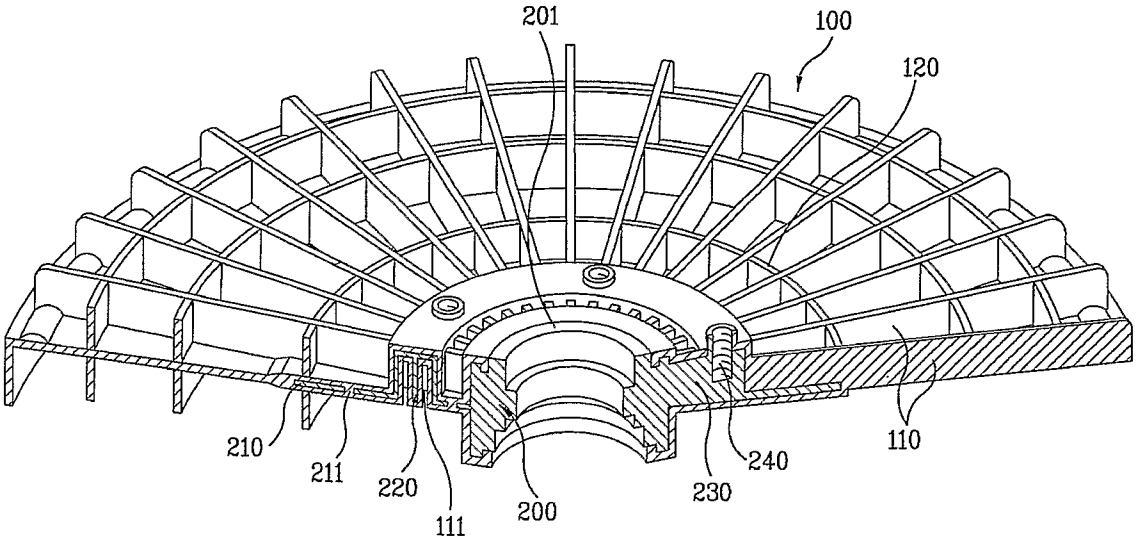
FIG. 5 is a partially cut perspective view illustrating a part of a rear wall of a tub in a direct-coupled type drum washing machine according to one embodiment of the present invention.

The flange 210 comprises bosses 240 to fasten a stator 6 (see FIGS. 1 and 4). The bosses 240 are shown as being formed in the protruded part 216 in FIG. 6, whereas the bosses 240 are shown as being formed in the recessed part 215 in FIG. 7.

Referring to FIG. 7, radial ribs 231 and a circumferential rib 220 for supporting the bosses 240 are formed corresponding to the bosses 240 in the recessed part of the flange facing the inner side of the rear wall of the tub 100. Since the radial ribs 231 and the circumferential rib 220 support an associated boss 240 in a cross shape, the strength of each boss 240 is reinforced.

Either the circumferential rib 220 or the radial ribs 230 can assist reinforcement of the flange. However, since the radial ribs 230 are connected with the circumferential rib 220 while being connected with each other via the circumferential rib 220, the strength of the flange is further enhanced.

Although the radial ribs 230 are shown as not extending to a distal end of the flange 210 in the drawings, it is needless to say that the radial ribs 230 can extend to the distal end thereof. If the radial ribs 230 are formed to extend to the distal end of the flange 210, there is a need that each radial rib 230 has a lower height outside a circumference in which the bosses 240 are positioned in preparation of fastening with the stator according to cases. Unless the radial ribs do not have such a height outside the circumference, the radial ribs can interfere with a coil 66 (see FIG. 4) of the stator.

In addition, the flange 210 comprises through-holes 211 for enhancing coupling force between the flange and the rear wall of the tub 100. The melted plastic flows through the through-holes 211, and connects the inner side of the rear wall of the tub 100 with the outer side thereof, so that the coupling force between the rear wall of the flange 100 and the bearing housing 200 is increased.

Each of the through-holes 211 has a slot shape or a circular shape. Preferably, the through-holes 211 have the slot shape. In addition, the through-holes 211 are uniformly arranged along each of plural circumferences on the flange 210. Uniform arrangement is required to prevent concentration of load on a specific part.

The tub 100 shown in FIG. 5 is the tub having the bearing housing 200 integrally inserted therein, and comprises circumferential ribs 120 and radial ribs 110.

In this embodiment, the circumferential rib 220 of the bearing housing 200 is inserted in an inner side circumferential rib among the circumferential ribs 120 of the rear wall of the tub 100, while the radial ribs 230 and 231 of the bearing housing 200 are inserted in portions of the radial ribs 110 of the rear wall of the tub 100 adjacent to the center.

Among the ribs of the rear wall of the tub 100, the ribs adjacent to the bosses 240 are thicker than other ribs. In this embodiment, since the ribs in the flange 210 of the bearing housing 200 are inserted in the ribs of the tub 100, the ribs of the tub 100 are thicker than other ribs. However, even in the case where the ribs of the flange are not inserted, it is necessary to make the ribs adjacent to the bosses 240 among the ribs of the rear wall of the tub 100 thicker than the other ribs. This structure reinforces the strength around the bosses and the center of the rear wall of the tub. Since a large load is transferred to a portion around the center of the rear wall of the tub, it is necessary to reinforce the portion around the center of the rear wall of the tub.

In addition, on the rear wall of the tub 100, a portion of each radial rib 110 and the circumferential ribs 120 outside the protruded part 216 have lower heights than those inside the protruded part 216 as shown in FIG. 5 in order to allow the stator to be fastened thereto, as shown in FIG. 4. That is, this is for the purpose of preventing them from interfering with the coil 66 (see FIG. 4) of the stator where the coil of the stator is wound, as shown in FIG. 4.

On the tub 100, the radial ribs 110 and the circumferential ribs 120 cross each other, and are arranged uniformly. Such crossing and uniform arrangements prevent load transferred to the rear wall of the tub 100 from being concentrated on a specific part, thereby preventing concentration of stress. In view of mechanics, such arrangements enable advantageous stress distribution on the rear wall of the tub 100.

Figure 8:
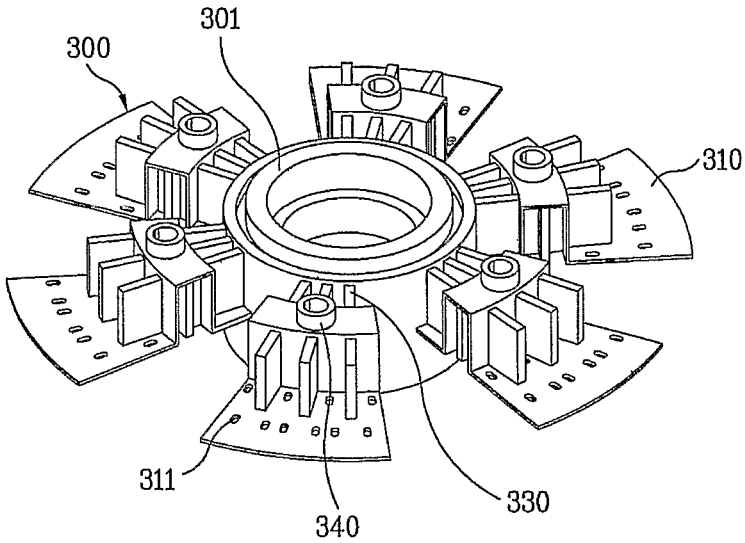
FIG. 8 illustrates another embodiment of a bearing housing.
Figure 9:
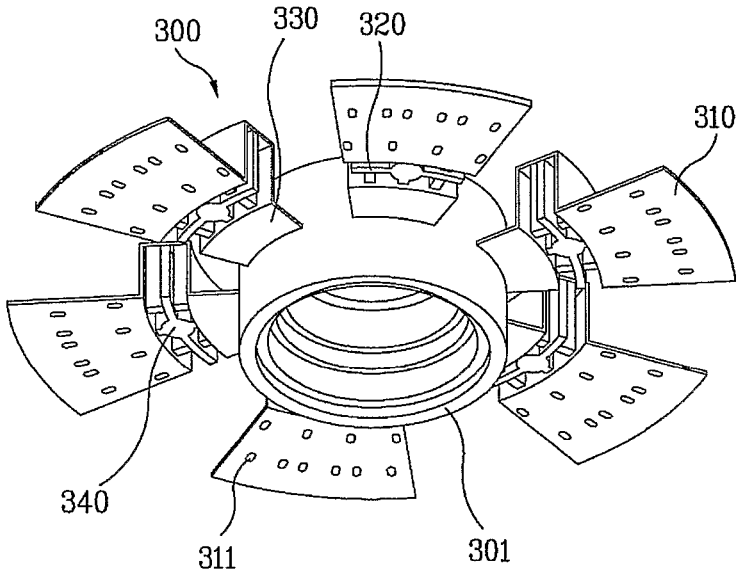
FIG. 9 illustrates a face of the bearing housing shown in FIG. 8 corresponding to the inner side of the rear wall of the tub.
Figure 10:
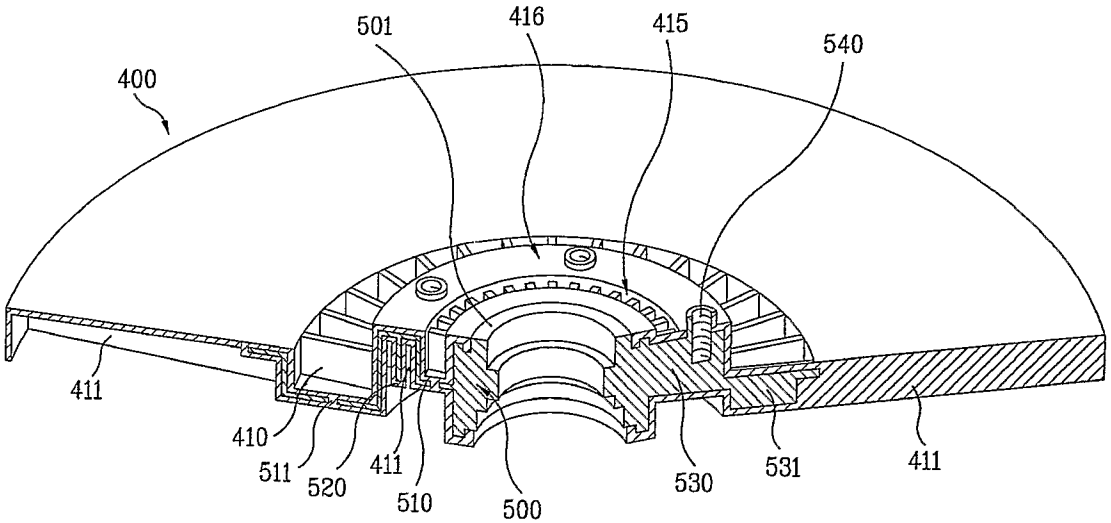
FIG. 10 is a partially cut perspective view illustrating a part of a rear wall of a tub in a direct-coupled type drum washing machine according to another embodiment of the present invention.

FIGS. 8 and 9 illustrate another embodiment of a bearing housing 300 which can be inserted in the tub. The bearing housing of this embodiment has substantially the same structure as that of the bearing housing shown in FIGS. 6 and 7 excluding that the flange is cut at several parts so as to be discontinuous in the circumferential direction.

As shown in the drawings, the flange 310 of this embodiment also comprises a recessed part, a protruded part, radial ribs 330 and a circumferential rib 320 formed in the recessed part. In addition, the flange 310 is also further provided with bosses to fasten the stator.

However, unlike the bearing housing of the previously described embodiment, the bearing housing 300 of this embodiment has the flange 310 which is not continuously formed in the circumferential direction. As shown in the drawings, the flange 310 is partially cut away to have discontinuous parts in the circumferential direction. In this embodiment, the flange 310 of the bearing housing 300 may not have the through holes 311. The reason is that, since inner and outer sides of the rear wall of the tub 100 are connected with each other via the discontinuous parts, the discontinuous parts serve as the though-holes 311.

FIGS. 10 to 14 show a tub 400 for a washing machine in accordance with another embodiment of the present invention.

Figure 12:
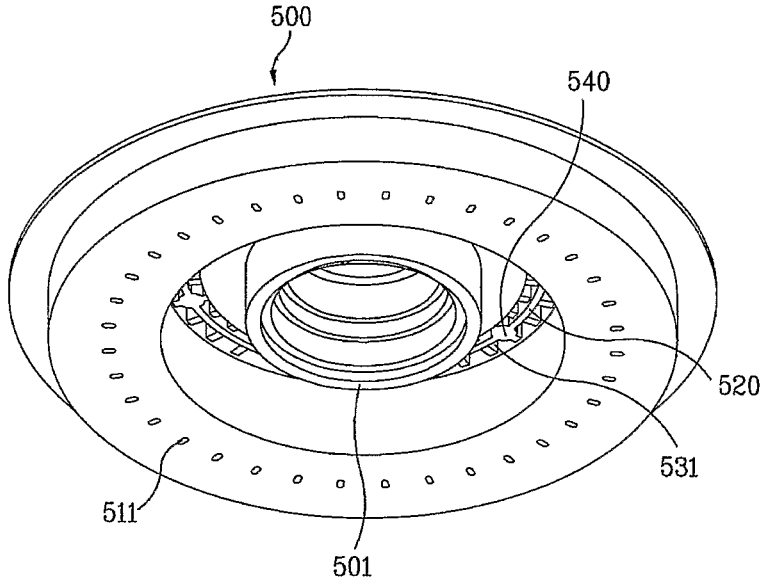
FIG. 12 illustrates a face of the bearing housing shown in FIG. 11 corresponding to the inner side of the rear wall of the tub.

As in the previously described embodiment, according to this embodiment, a flange 510 of a bearing housing has a recessed part 515 and a protruded part 516, and extends from the bearing housing 501. In addition, the recessed part 515 is formed with radial ribs 530 and 531 or a circumferential rib 520. The circumferential rib 520 is formed around bosses 540, and reinforces the bosses 540 as shown in FIG. 12. Since each of the bosses 240 is supported in a cross shape by an associated radial rib 231 and the circumferential rib 220, the strength of each boss 240 is reinforced.

Figure 11:
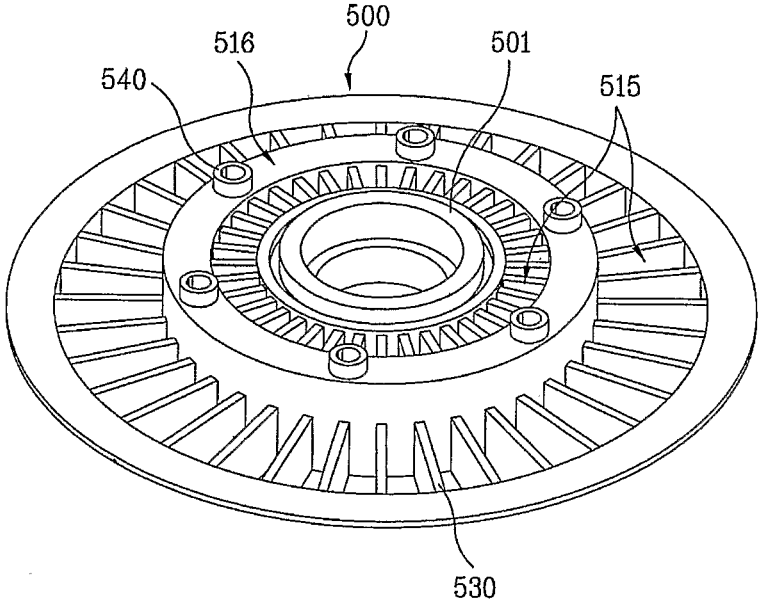
FIG. 11 illustrates one embodiment of a bearing housing inserted in the tub shown in FIG. 10.

As shown in FIG. 11, the flange 510 is provided with two recessed parts 515 on a face corresponding to an cater side of the rear wall of the tub 400, and each of the recessed parts 515 is provided with radial ribs 530 which serve to reinforce the strength and rigidity of the recessed parts 515. As such, when the number of the recessed parts 515 or the protruded parts 516 is increased, the strength and rigidity of the rear wall of the tub 400 are reinforced by an increased number of these parts. If the rear wall of the tub is not formed with the recessed part 414 and the protruded part 416 to have a flat shape, the tub becomes excessively flexible, causing a problem in terms of strength and rigidity.

In addition, the flange 510 is provided with the bosses 540 for fastening of the stator at the protruded part 516 of the surface corresponding to the outer side of the rear wall of the tub 400. The bosses are positioned at the recessed part (see FIG. 12) for the surface corresponding to the inner side of the rear wall of the tub 400.

In addition, the flange 510 is provided with through-holes 511 as shown in the drawings. The through-holes may be slot holes or circular holes.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

INDUSTRIAL APPLICABILITY

The present invention relates to a tub for a washing machine and a washing machine comprising the same. More particularly, the present invention relates to a tub formed through injection molding with a bearing housing inserted therein, and a washing machine comprising the same. Here, the bearing housing comprises a flange having a recessed part and a protruded part in the radial direction.

The present invention can solve the problems of the conventional washing machine as described above, and provide the tub and the washing machine comprising the same, both of which fulfill various requirements.

According to the present invention, the tub is formed by injection molding with the bearing housing inserted therein so that it has excellent strength and rigidity of the rear wall thereof, exhibits a strong coupling force with respect to the inserted bearing housing, and reduces manufacturing costs. Thus, the washing machine has all the characteristics of the tub according to the present invention.

The invention claimed is:

1. A washing machine comprising a tub formed by injection molding with a bearing housing inserted in the tub, wherein the bearing housing comprises:

a bearing support that receives one or more bearings therein;

a flange that extends outward from the bearing support, the flange including a protruded part and a recessed part, wherein the flange is formed as a single body with the bearing support and is configured to be coupled to a stator of a motor, and wherein the protruded part and the recessed part are concentrically arranged with respect to the bearing support, and are alternately arranged in a radial direction;

a plurality of radial ribs positioned in a concave area defined by an underside of the protruded part, wherein the plurality of radial ribs extend radially therein and are arranged circumferentially therein; and a circumferential rib positioned in the concave area defined by the underside of the protruded part so as to connect the plurality of radial ribs.

2. The washing machine according to claim 1, wherein the flange includes ribs positioned in the recessed part, the ribs including at least one of a plurality of radial ribs or a circumferential rib.

3. The washing machine according to claim 2, wherein the ribs include the plurality of radial ribs and the circumferential rib, the plurality of radial ribs being positioned so as to cross the circumferential rib.

4. The washing machine according to claim 1, further comprising bosses provided in the protruded part of the flange and configured to fasten the stator of the motor thereto.

5. The washing machine according to claim 1, wherein the flange is continuously formed in a circumferential direction.

6. The washing machine according to claim 1, wherein the flange includes a plurality of cutaway sections so as to be discontinuous in a circumferential direction.

7. A washing machine comprising a tub formed by injection molding with a bearing housing inserted in the tub, wherein the bearing housing comprises:

a bearing support that receives one or more bearings therein; and a flange that extends outward from the bearing support, the flange including a protruded part and a recessed part, wherein the flange is formed as a single body with the bearing support and is configured to be coupled to a stator of a motor, wherein the protruded part and the recessed part are concentrically arranged with respect to the bearing support, and are alternately arranged in a radial direction, wherein the recessed part is formed adjacent to and surrounding an outer circumference of the bearing support, and the protruded part is formed adjacent to and surrounding an outer circumference of the recessed part;

a plurality of radial ribs positioned in a concave area defined by an underside of the protruded part, wherein the plurality of radial ribs extend radially therein and are arranged circumferentially therein; and a circumferential rib positioned in the concave area defined by the underside of the protruded part so as to connect the plurality of radial ribs.

8. The washing machine according to claim 7, wherein the flange includes ribs positioned in the recessed part, the ribs including at least one of a plurality of radial ribs or a circumferential rib.

9. The washing machine according to claim 8, wherein the ribs include the plurality of radial ribs positioned so as to cross the circumferential rib.

10. The washing machine according to claim 8, further comprising bosses provided in the at least one of the circumferential rib or the plurality of radial ribs and configured to fasten the stator of the motor thereto.

11. The washing machine according to claim 8, wherein the flange is continuously formed in a circumferential direction.

12. The washing machine according to claim 7, further comprising through-holes formed in the flange.

13. The washing machine according to claim 12, wherein the through holes are slot holes or circular holes.

14. The washing machine according to claim 7, further comprising bosses provided in the protruded part and configured to fasten the stator of the motor thereto.

15. The washing machine according to claim 7, wherein the flange includes a plurality of cutaway sections so as to be discontinuous in a circumferential direction.

16. The washing machine of claim 7, wherein the protruded part and the recessed part each extend around an entire circumference of the bearing support.

17. The washing machine of claim 7, wherein the flange further comprises a flat part extending from the protruded part of the flange to an end of the flange.

18. The washing machine of claim 7, further comprising:

a plurality of radial ribs positioned in the recessed part, extending radially therein and arranged circumferentially therein; and a circumferential rib positioned in the recessed part so as to connect the plurality of radial ribs.

19. The washing machine of claim 18, further comprising a plurality of fastening bosses provided in the recessed part, wherein the plurality of fastening bosses are configured to receive fasteners therein so as to couple the flange to the stator of the motor.

20. The washing machine of claim 18, further comprising a plurality of fastening bosses provided in the protruded part, wherein the plurality of fastening bosses are configured to receive fasteners therein so as to couple the flange to the stator of the motor.

* * * * *